US005782248A

United States Patent [19]

Chang

[11] Patent Number: 5,782,248

[45] Date of Patent: Jul. 21, 1998

[54] METHOD FOR APPLYING FRENCH MANICURES TO FINGERNAILS

[75] Inventor: Sung Yong Chang, Palisades Park, N.J.

[73] Assignee: Kiss Products, Inc., Port Washington, N.Y.

[21] Appl. No.: 686,097

[22] Filed: Jul. 24, 1996

[51] Int. Cl.[6] ..... A45D 29/00

[52] U.S. Cl. ..... 132/200

[58] Field of Search ..... 132/200, 285, 132/73

[56] References Cited

U.S. PATENT DOCUMENTS

| | | | |
|---|---|---|---|
| 1,889,484 | 11/1932 | Marshburn | 132/73 |
| 2,162,155 | 6/1939 | Calvin | 132/73 |
| 2,234,657 | 3/1941 | Smaldone | 132/285 |
| 2,239,040 | 4/1941 | Holmes | 132/285 |
| 3,598,685 | 8/1971 | Lee et al. | 132/73 |
| 3,736,946 | 6/1973 | Yando et al. | 132/73 |
| 3,898,357 | 8/1975 | Miller et al. . | |
| 5,133,369 | 7/1992 | Billings . | |
| 5,398,704 | 3/1995 | Dombeck | 132/285 |
| 5,427,121 | 6/1995 | Polito | 132/200 |
| 5,638,837 | 6/1997 | Juhl et al. | 132/73 |

FOREIGN PATENT DOCUMENTS

| | | | |
|---|---|---|---|
| 3347437 | 7/1985 | Germany | 132/73 |
| 2111431 | 7/1983 | United Kingdom | 132/73 |

*Primary Examiner*—Todd E. Manahan
*Attorney, Agent, or Firm*—Collard & Roe, P.C.

[57] ABSTRACT

A method for applying French manicures to fingernails having specialized French manicure style decals is shown. After a base coat of polish is applied to the fingernail, the French manicure style decal is applied to the fingernail using an adhesive material. The French manicure style decal has an opaque portion for creating the French manicure on the free edge of the fingernail, and a decorative design portion for including an intricate decorative design on the nail plate with the French manicure. After the application of the French manicure style decal, an additional layer of polish is applied to the fingernail to further secure the decal in place, and to increase the strength and durability of the fingernail.

2 Claims, 4 Drawing Sheets

METHOD FOR APPLYING FRENCH MANICURES TO FINGERNAILS

BACKGROUND OF THE INVENTION

1. Field of the Invention

The present invention relates to French manicures for fingernails. More particularly, it relates to method for applying a French manicure and packaging for the necessary materials.

2. The Prior Art

U.S. Pat. No. 3,898,357 to Miller et al., discloses methods and decal apparatus for decorating the nails of fingers and toes. The invention consists of a decal that is applied to a nail to provide a decorative nail surface. The decals come in groups of several sizes, and are adhered to a carrier sheet by way of a water activated adhesive. The process recited includes pre-coating the nail with a lacquer prior to application of the decal; applying the decal as desired; and coating the decal and nail with a transparent lacquer.

U.S. Pat. No. 5,133,369 to Billings, discloses a method of applying nail art to fingernails. The invention consists of suspending a given amount of nail polish within a liquid medium, and then artistically decorated to create a desired design. Once a design is achieved the user lightly presses their fingernail into the liquid medium with polish design to transfer the design from said liquid medium onto the fingernail.

SUMMARY OF THE INVENTION

The present invention provides a process of applying a French manicure to fingernails.

According to a first embodiment of the invention, a specialized decal is applied to a user's fingernail after the application of a base coating. The specialized decal has a first portion for covering the tip of the nail, and second portion for providing a decorative design on the fingernail. The first portion of the decal is opaque, and provides a French manicure on the free edge of the nail without requiring the application of polish. The second decorative portion of the decal provides various different intricate designs to enhance the French manicure style. Once the decal is applied to the fingernail, an additional top coat layer is applied to further secure the decal, and provide more strength and durability to the fingernail. In another embodiment, the french manicure is applied to the free edge of the nail in the classic painting method, and the decal applied to the nail is an intricate design that is disposed on the nail plate.

In another embodiment of the invention, a French manicure is applied by brushing a white polish on the free edge of the nail using tip guides. The tip guide provides a perfect French manicure on the free edge of the user's fingernail. Once the tip is applied, the user can apply additional coats of polish to increase the strength and durability of the fingernail and enhance the appearance of the French manicure.

A specialized package is provided that includes the French manicure decal sheets and the requisite nail polishes and base coat materials. In addition a plurality of various shaped tip guides are provided for applying a French manicure using the classic standard method.

It is therefore an object of the present invention to provide a method for applying a French manicure that is more efficient that the classic standard method.

It is another object of the invention to provide a method for applying a French manicure that utilizes specialized decals to eliminate the application of the French manicure to the free edge of the nail.

A further object of the invention is to provide two methods for applying a French manicure that are simple to use, inexpensive in cost, and provides superior results while requiring less time.

Yet another object of the invention is to provide packaging for all of the requisite materials associated with the method for applying French manicures to fingernails.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
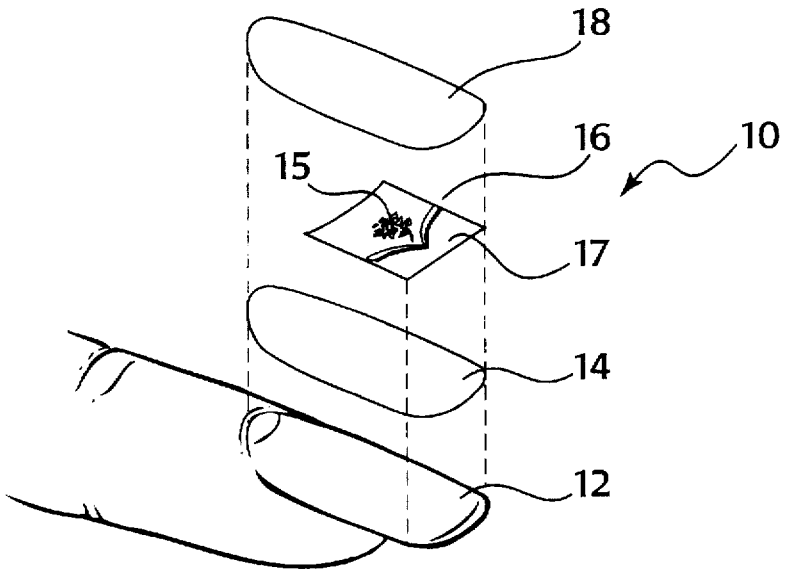
FIG. 1 is an exploded perspective view of the application of a French manicure according to the invention.

Turning now in detail to the drawings, FIG. 1 shows a first embodiment of the process 10*a* of applying a French manicure to a fingernail. A first layer of polish 14 is applied to the user's fingernail 12 by brushing on a desired color. Polish 14 can be any color, but is preferably pink or natural (clear) color such that the enhancement effect of the French manicure is not overcome by the color of the undercoat polish 14.

After polish 14 is applied, a French manicure style decal 16 is removed from a decal sheet 20 (FIG. 2*a*) and applied to fingernail 12 such that an opaque portion 17 is disposed along the free edge of nail 12, and the floral design 15 is disposed on the nail plate. The opaque portion 17 is preferably white in color, but may be any color the user desires. Decal 16 allows the user to apply a perfect French manicure to the free edge and a decorative design to the nail plate of fingernail 12 without requiring the use of a polish to apply either the French manicure or design. The use of decal 16 enables the user to apply a much more intricate design 15 to nail 12 than would otherwise be possible, in addition to requiring significantly less time for the application.

Figure 2A:
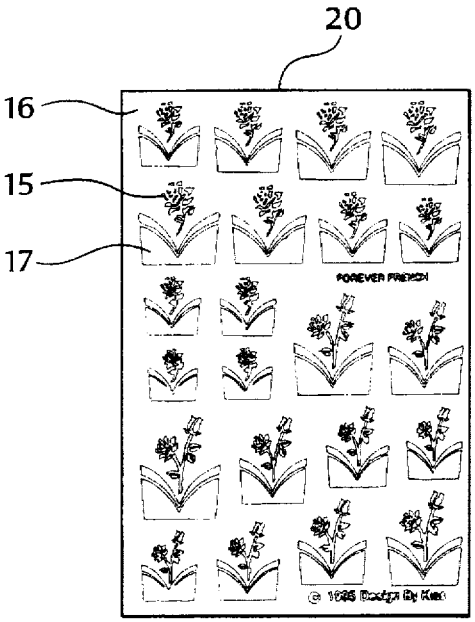
FIG. 2*a* is a first embodiment of a decal sheet according to the invention.
Figure 2B:
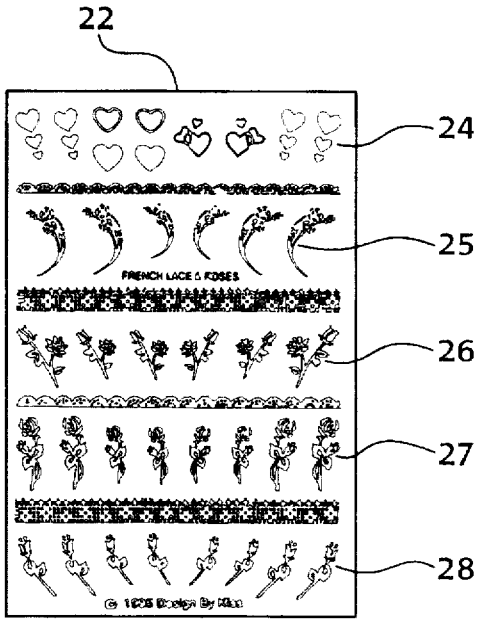
FIG. 2*b* is a second embodiment of a decal sheet according to the invention.

FIGS. 2*a* and 2*b* show examples of decal sheets 20 and 22, respectively. Decal sheet 20 has a plurality of French manicure style decals 16 of various sizes. Each decal 16 is disposed on a clear film like material, and has an opaque portion 17 and a design portion 15. The opaque portion 17 is disposed on the free edge of the users fingernail, and design 15 extends outward from the opaque portion and is disposed on the nail plate. Opaque portion 17 creates a perfect French manicure on the free edge of the users fingernail, without requiring the user to brush or paint on the opaque polish to the free edge by hand. The use of decal 16 saves time in applying French manicures to nails.

Decal sheet 22 has a plurality of decals 24–28 each having different designs and various sizes to accommodate various size fingernails. Decals 24–28 add an intricate decorative feature to the standard French manicure that could not be painted on by hand. Decals 16 and 24–28 have an adhesive on the underside there of for applying the decal to the fingernail. The adhesive for the decals is preferably a water activated adhesive, but may be any other suitable known type of adhesive for this application.

Figure 3A:
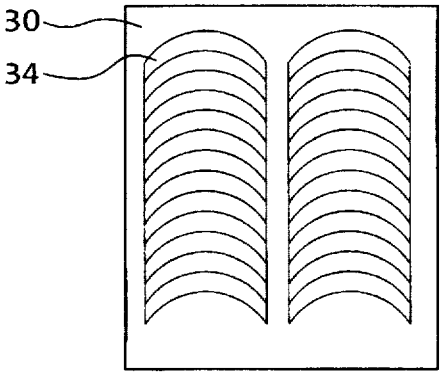
FIG. 3*a* is a first embodiment of tip guides according to the invention.
Figure 3B:
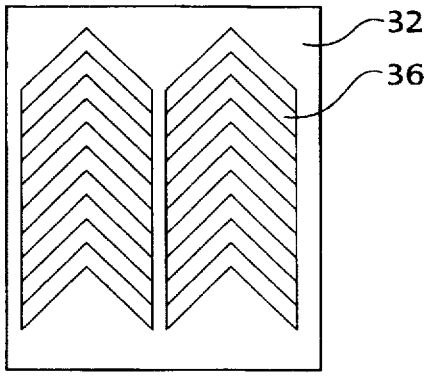
FIG. 3*b* is a second embodiment of tip guides according to the invention.

FIGS. 3*a* and 3*b* show tip guide sheets 30 and 32 for use in applying a standard or classic French manicure. A classic French manicure consists of applying a polish to the free edge of a nail that is a different color than the rest of the nail. The color applied is preferably white, but may be another similar type color, such as, for example, off-white, cream, etc.

Figure 3C:
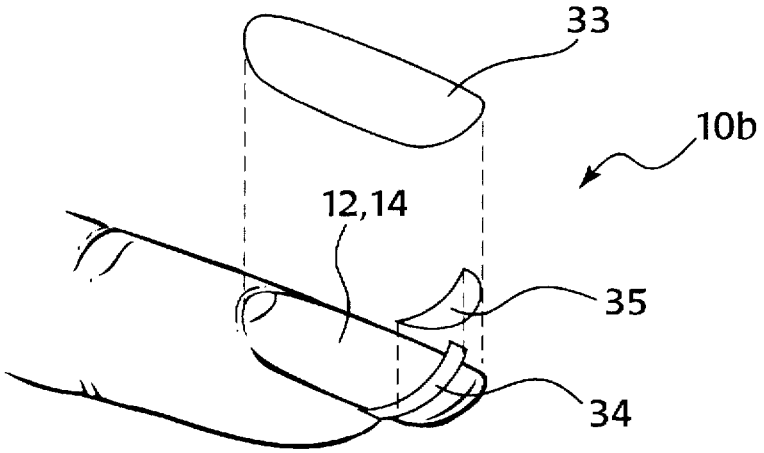
FIG. 3*c* shows a perspective view of an application of a french manicure using a tip guide according to the invention.

FIG. 3*c* shows an embodiment 10*b* of applying a French manicure using a tip guide 34 for applying an opaque polish to the free edge of the nail 12. Tip guide 34 is applied to fingernail 12 after the base coat 14 (FIG. 1) has been applied. The user then polishes the free edge of nail 12 with a polish 35 of their choice. When the user is finished with polish 35, tip guide 34 is removed, and the user has a perfect French manicure on the free edge of nail 12. After polish 35 is applied, and tip guide 34 is removed, the user may apply an additional coat of nail polish 33 to the entire fingernail 12 for providing additional strength and durability, and enhancing the cosmetic appearance.

Figure 3D:
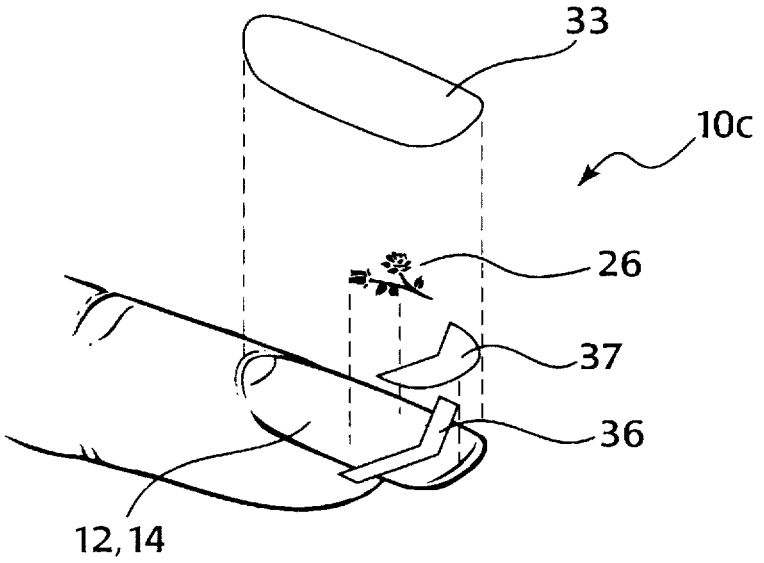
FIG. 3*d* shows an exploded perspective view of an alternative application of a french manicure according to the invention.

FIG. 3*d* shows an embodiment 10*c* of applying a French manicure using a tip guide 36 for providing a different effect. Tip guide 36 is V-shaped, and is applied to fingernail 12 as shown. Once tip guide 36 is in place, the user then polishes the free edge of fingernail 12 with a polish 37. After polish 37 is applied, tip guide 36 is removed, and the user has a V-shaped French manicure. After the French manicure has been applied, a decal 26 can be placed on fingernail 12 to add an intricate decorative effect to the French manicure. Once decal 26 has been disposed on fingernail 12, an additional coat of polish 33 is added to further secure the decal in place, and protect the appearance of the French manicure.

Figure 4:
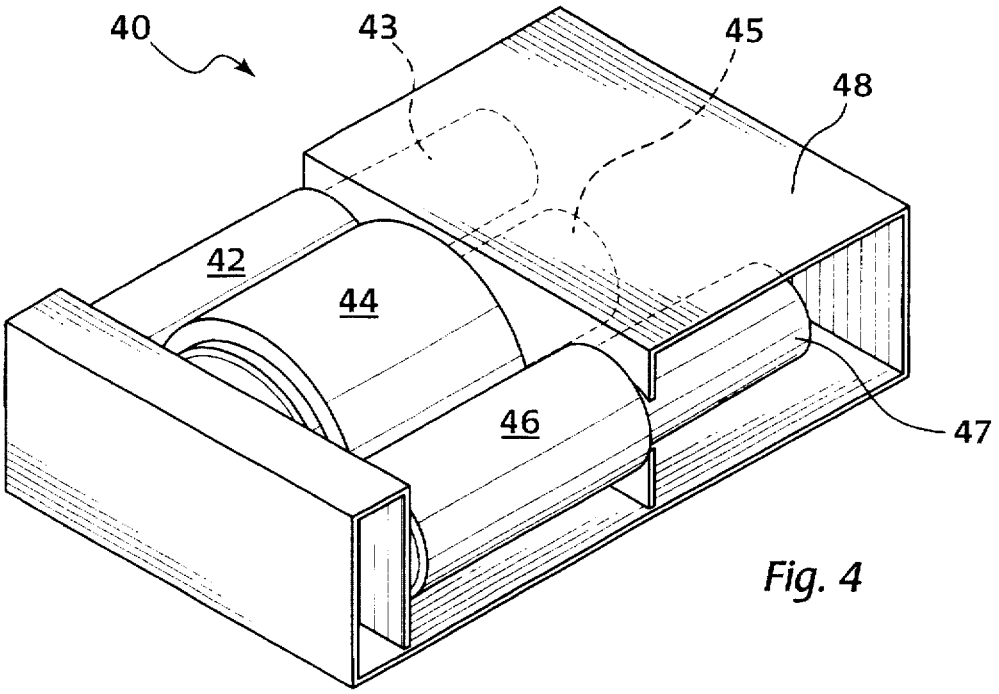
FIG. 4 is a perspective view of the packaging for the French manicure kit according to the invention.

FIG. 4 shows a package 40 for enclosing all the necessary items for the French manicure process according to the invention. Package 40 has an insert 48 that receives and secures three bottles 42, 44, and 46 in place. Bottles 42, 44, and 46 are the necessary base coat, top coat, and white tip accent polishes for applying either a classic French manicure with tip guides 30 or 32, or a decal type French manicure using the decals on decal sheets 20 and 22.

Figure 5:
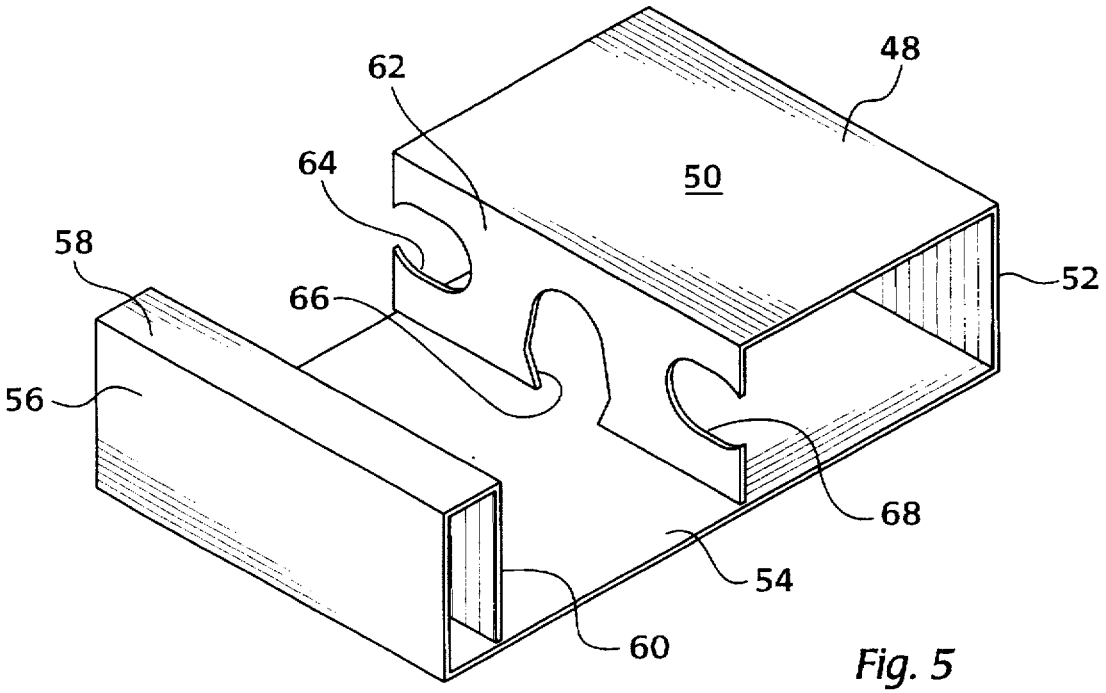
FIG. 5 is a perspective view of the packaging insert according to the invention.

FIG. 5 shows the insert 48 having bottle receiving openings 64, 66, and 68. Openings 64, 66, and 68 are designed to releasably receive the bottle necks with caps 43, 45, and 47, of bottles 42, 44, and 46, respectively. Insert 48 has multiple panels 50, 52, 54, 56, 58, 60 and 62. Each panel is folded such that it is disposed perpendicular to the next adjacent panel. Panels 50 and 54 are disposed perpendicular with respect to panel 54, panels 58 and 54 are disposed perpendicular with respect to panel 56, and panel 60 is disposed perpendicular with respect to panel 58. Panel, 62 with openings 64, 66, and 68, is also disposed perpendicular with respect to panel 50.

Thus , when bottles 42, 44, and 46 are disposed within insert 48, decal sheets 20 and 22, and tip guide sheets 30 and 32 can be disposed underneath said bottles and against panel 54.

While several embodiments of the present invention have been shown and described, it is to be understood that many changes and modifications may be made thereunto without departing from the spirit and scope of the invention as defined in the appended claims.

What is claimed is:

1. A method of applying a French manicure to fingernails comprising the steps of:

applying a base coat of polish to the fingernail;

allowing the base cost to dry;

placing a tip guide on the fingernail such that a free edge of the fingernail is exposed;

applying polish to the exposed free edge of the fingernail, said polish being applied over said base coat;

removing the tip guide from the fingernail;

allowing the polish applied to the free edge to dry;

applying a top coat of polish to the entire fingernail to protect the applied free edge of polish and to further increase the strength and durability of the fingernail.

2. The method according to claim 1, further comprising the steps of:

providing a decorative decal for application to the fingernail; and applying the decorative decal to the fingernail after said step of removing the tip guide from the fingernail.

* * * * *